US006053824A

United States Patent [19]

Boudreaux

[11] Patent Number: 6,053,824

[45] Date of Patent: Apr. 25, 2000

[54] PORTABLE OBSTACLE COURSE SYSTEM

[76] Inventor: Glen T. Boudreaux, 2060 Halsey Ave., New Orleans, La. 70114

[21] Appl. No.: 09/233,571

[22] Filed: Jan. 19, 1999

[51] Int. Cl.[7] ..... A63B 71/02

[52] U.S. Cl. ..... 473/440; 473/459

[58] Field of Search ..... 273/440, 441, 273/444, 445, 446, 459; 434/251, 255, 258; 472/92; 473/438, 440, 465, 490, 415, 422; 482/17, 35, 51

[56] References Cited

U.S. PATENT DOCUMENTS 2,323,291 7/1943 Bens .
2,685,140 8/1954 Nedwick ..... 434/255
3,255,115 6/1966 Peterson .
3,433,480 3/1969 Coleman et al. .
3,578,323 5/1971 Coleman et al. .
4,059,268 11/1977 Forrest .
4,134,586 1/1979 King .
5,199,930 4/1993 Weber ..... 482/17
5,205,748 4/1993 Petersheim ..... 434/258

*Primary Examiner*—Raleigh W. Chiu
*Attorney, Agent, or Firm*—Joseph N. Breaux

[57] ABSTRACT

A portable obstacle course system that includes of number of child safe obstacle elements that is used as an entertainment activity for birthday parties and the like activities. The system is easily transported to the activity site, is rapidly set up in a variety of configurations and is rapidly taken down after the activities are over.

1 Claim, 2 Drawing Sheets

10
12
14
16
18
20
22
28
32
34
36
38
39
40a
40b
40c
42
46
50
60
62
64
66

PORTABLE OBSTACLE COURSE SYSTEM

TECHNICAL FIELD

The present invention relates to children's entertainment systems and more particularly to a portable obstacle course system for entertaining children that includes a number of boundary cones each having a number of boundary rod receiving fittings formed into the tip end thereof; a number of boundary rods each having rod ends sized to frictionally fit into the boundary rod receiving fittings of the boundary cones; two high stepper assemblies each including a framework defining a number of rectangular foot placement openings laid out in a grid pattern, the framework being covered with a resilient foam cushion; two tunnel assemblies each including a resilient mat assembly having three hingedly connected tunnel mat sections each having an upper surface provided with a number of tunnel support securing straps and a number of U-shaped tunnel supports that are provided with ground insertion ends adapted for insertion into the ground, the U-shaped tunnel supports and the three tunnel mat sections being sized such that the tunnel support securing straps are securable about sections of the U-shaped tunnel supports to hold the three tunnel mat sections in a tunnel configuration forming a tunnel passageway through which a child can crawl; and an A-frame scaling structure including a scaling structure support frame, an angled mesh scaling wall supported by the scaling structure support frame, a planar padded scaling wall supported by the scaling structure support frame, and a foam ridge structures positioned in connection with the top edges of the angled mesh scaling wall and the planar padded scaling wall.

BACKGROUND ART

Children often find it enjoyable to compete in physical contests that involve running, jumping, crawling, climbing, etc. Because children often find such activities enjoyable, it would be a benefit to have a portable obstacle course system that could be used as an entertainment activity for birthday parties and the like activities that could be easily transported to the activity site, that could be rapidly set up in a variety of configurations and that could be rapidly taken down.

GENERAL SUMMARY DISCUSSION OF INVENTION

It is thus an object of the invention to provide a portable obstacle course system that is used as an entertainment activity for birthday parties and the like activities.

It is a further object of the invention to provide a portable obstacle course system that is easily transported to the activity site.

It is a still further object of the invention to provide a portable obstacle course system that is rapidly set up in a variety of configurations and rapidly taken down.

It is a still further object of the invention to provide a portable obstacle course system that includes a number of boundary cones each having a number of boundary rod receiving fittings formed into the tip end thereof; a number of boundary rods each having rod ends sized to frictionally fit into the boundary rod receiving fittings of the boundary cones; two high stepper assemblies each including a framework defining a number of rectangular foot placement openings laid out in a grid pattern, the framework being covered with a resilient foam cushion; two tunnel assemblies each including a resilient mat assembly having three hingedly connected tunnel mat sections each having an upper surface provided with a number of tunnel support securing straps and a number of U-shaped tunnel supports that are provided with ground insertion ends adapted for insertion into the ground, the U-shaped tunnel supports and the three tunnel mat sections being sized such that the tunnel support securing straps are securable about sections of the U-shaped tunnel supports to hold the three tunnel mat sections in a tunnel configuration forming a tunnel passageway through which a child can crawl; and an A-frame scaling structure including a scaling structure support frame, an angled mesh scaling wall supported by the scaling structure support frame, a planar padded scaling wall supported by the scaling structure support frame, and a foam ridge structures positioned in connection with the top edges of the angled mesh scaling wall and the planar padded scaling wall.

It is a still further object of the invention to provide a portable obstacle course system that accomplishes all or some of the above objects in combination.

Accordingly, a portable obstacle course system is provided. The portable obstacle course system includes a number of boundary cones each having a number of boundary rod receiving fittings formed into the tip end thereof; a number of boundary rods each having rod ends sized to frictionally fit into the boundary rod receiving fittings of the boundary cones; two high stepper assemblies each including a framework defining a number of rectangular foot placement openings laid out in a grid pattern, the framework being covered with a resilient foam cushion; two tunnel assemblies each including a resilient mat assembly having three hingedly connected tunnel mat sections each having an upper surface provided with a number of tunnel support securing straps and a number of U-shaped tunnel supports that are provided with ground insertion ends adapted for insertion into the ground, the U-shaped tunnel supports and the three tunnel mat sections being sized such that the tunnel support securing straps are securable about sections of the U-shaped tunnel supports to hold the three tunnel mat sections in a tunnel configuration forming a tunnel passageway through which a child can crawl; and an A-frame scaling structure including a scaling structure support frame, an angled mesh scaling wall supported by the scaling structure support frame, a planar padded scaling wall supported by the scaling structure support frame, and a foam ridge structures positioned in connection with the top edges of the angled mesh scaling wall and the planar padded scaling wall.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
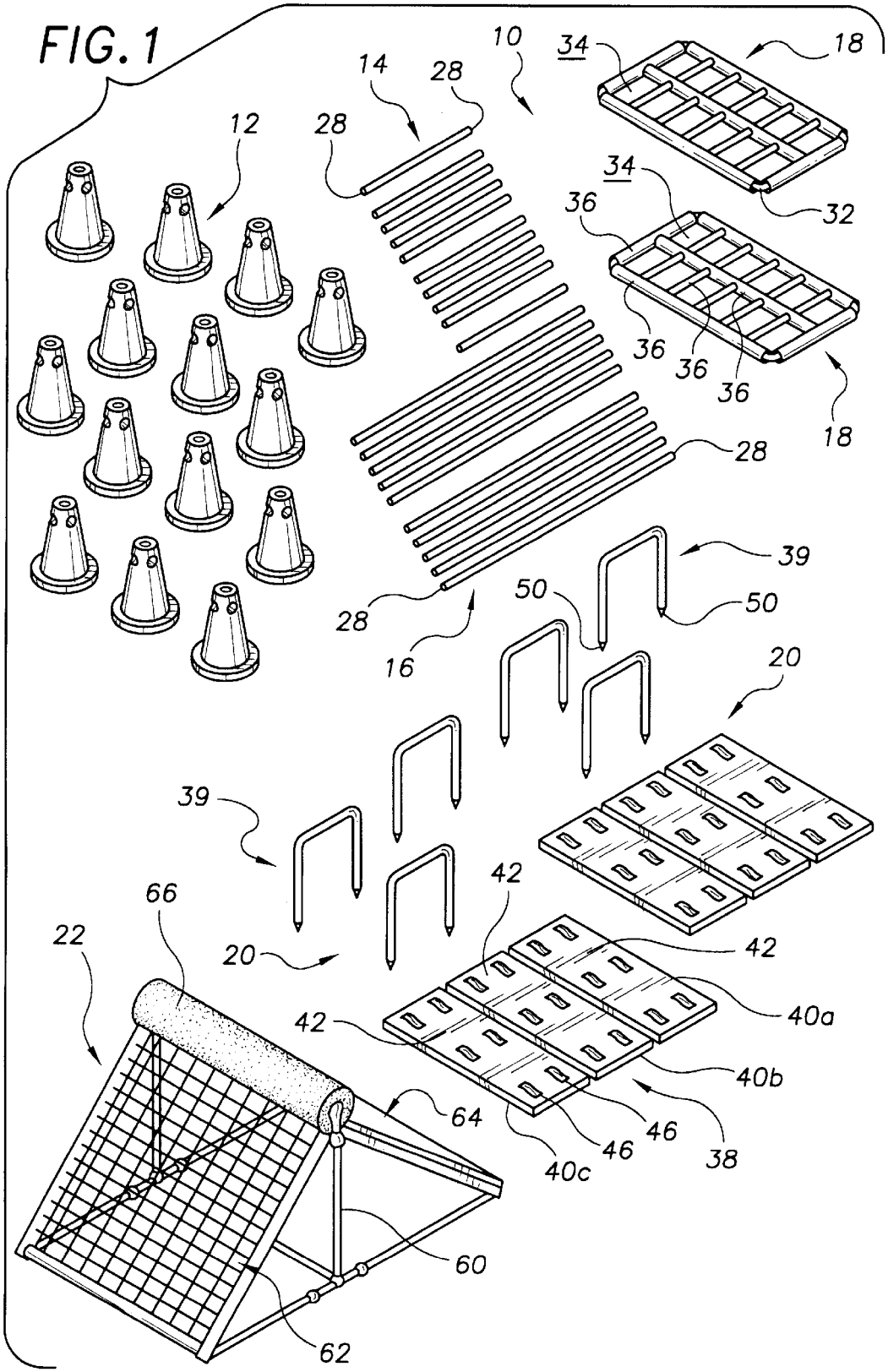
FIG. 1 is a perspective view of an exemplary embodiment of the portable obstacle course system of the present invention showing a number of exemplary boundary cones each having a number of boundary rod receiving fittings formed into the tip end thereof; a number of boundary rods each having rod ends sized to frictionally fit into the boundary rod receiving fittings of the boundary cones; two high stepper assemblies each including a framework defining a number of rectangular foot placement openings laid out in a grid pattern, the framework being covered with a resilient foam cushion; two tunnel assemblies each including a resilient mat assembly having three hingedly connected tunnel mat sections each having an upper surface provided with a number of tunnel support securing straps and a number of U-shaped tunnel supports that are provided with ground insertion ends adapted for insertion into the ground, the U-shaped tunnel supports and the three tunnel mat sections being sized such that the tunnel support securing straps are securable about sections of the U-shaped tunnel supports to hold the three tunnel mat sections in a tunnel configuration; and an A-frame scaling structure including a scaling structure support frame, an angled mesh scaling wall supported by the scaling structure support frame, a planar padded scaling wall supported by the scaling structure support frame, and a foam ridge structures positioned in connection with the top edges of the angled mesh scaling wall and the planar padded scaling wall.

FIG. 1 shows an exemplary embodiment of the portable obstacle course system of the present invention generally designated 10. Portable obstacle system 10 includes a number of identical molded plastic boundary cones, each generally designated 12; a number of short plastic boundary rods, each generally designated 14; a number of long plastic boundary rods, each generally designated 16; two identical high stepper assemblies, each generally designated 18; two identical tunnel assemblies, each generally designated 20; and an A-frame scaling structure, generally designated 22.

Figure 2:
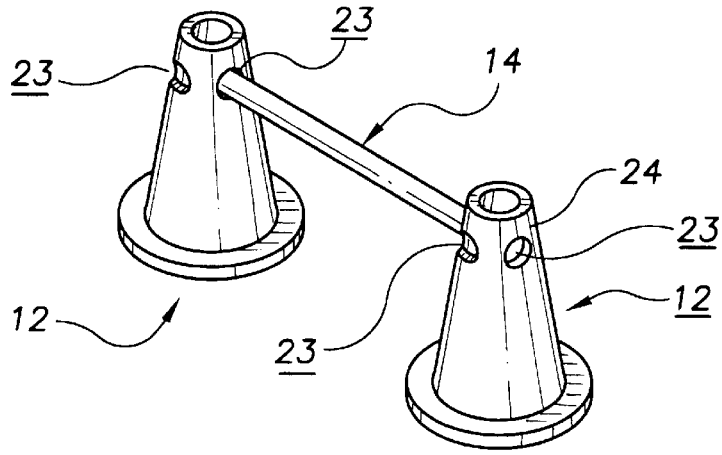
FIG. 2 is a perspective view showing two of the boundary cones having a boundary rod supported therebetween with each boundary cone having a rod end of the boundary rod frictionally inserted into a boundary rod receiving fitting thereof.

Referring to FIG. 2, each boundary cone 12 has four boundary rod receiving fittings 23 which are apertures formed into the tip end 24 thereof that are spaced on ninety degree centers. Boundary rod receiving fittings 23 are sized to frictionally receive and grip the rod ends 28 (FIG. 1) of the short plastic boundary rods 14 and the long plastic boundary rods 16 (FIG. 1).

Referring back to FIG. 1, short plastic boundary rods 14 and long plastic boundary rods 16 are lengths of colored plastic tubing having the same outer diameter. In use boundary cones 12, short boundary rods 14, and long boundary rods 16 are connected together to create a variety of mazes through which the children must pass as an obstacle element.

Each of the two high stepper assemblies 18 includes a lightweight tubular plastic framework 32 defining a number of rectangular foot placement openings 34 laid out in a grid pattern consisting of two parallel rows of foot placement openings 34. Framework 32 is covered with sections of resilient foam cushion material 36 to provide cushioned contact surfaces.

Figure 3:
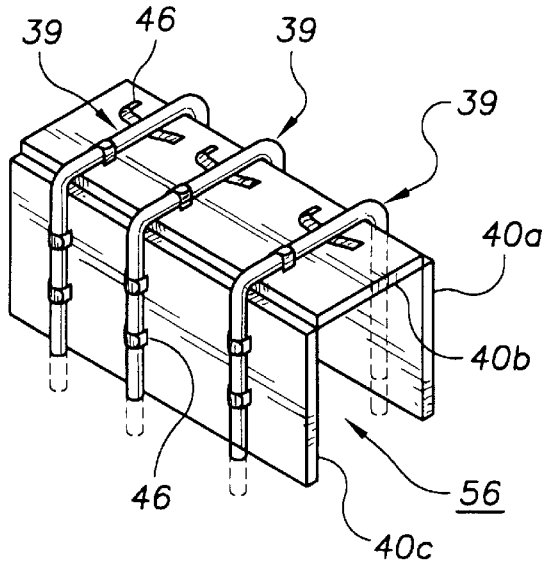
FIG. 3 is a perspective view showing one of the two tunnel assemblies in the tunnel configuration with the ground insertion ends of the three U-shaped tunnels supports inserted into the ground and the three hingedly connected tunnel mat sections of the resilient mat assembly secured to sections of the U-shaped tunnel supports with the tunnel support securing straps and held thereby to form a tunnel passageway.

Each of the two tunnel assemblies 20 includes a resilient mat assembly, each generally designated 38, and three U-shaped tunnel supports, each generally designated 39. Each resilient mat assembly 38 has three hingedly connected tunnel mat sections 40*a–c* that each have an upper surface 42 provided with three pairs of tunnel support securing straps 46. U-shaped tunnel supports 38 are of molded plastic construction and each includes two tapered ground insertion ends 50 adapted for insertion into the ground. Referring to FIG. 3, U-shaped tunnel supports 39 and the three tunnel mat sections 40*a–c* are sized such that the tunnel support securing straps 46 of each mat section 40*a–c* are securable about sections of the U-shaped tunnel supports 39 to hold the three tunnel mat sections 40*a–c* in a tunnel configuration to form a tunnel passageway 56 through which a child can be required to crawl as an obstacle element.

Figure 4:
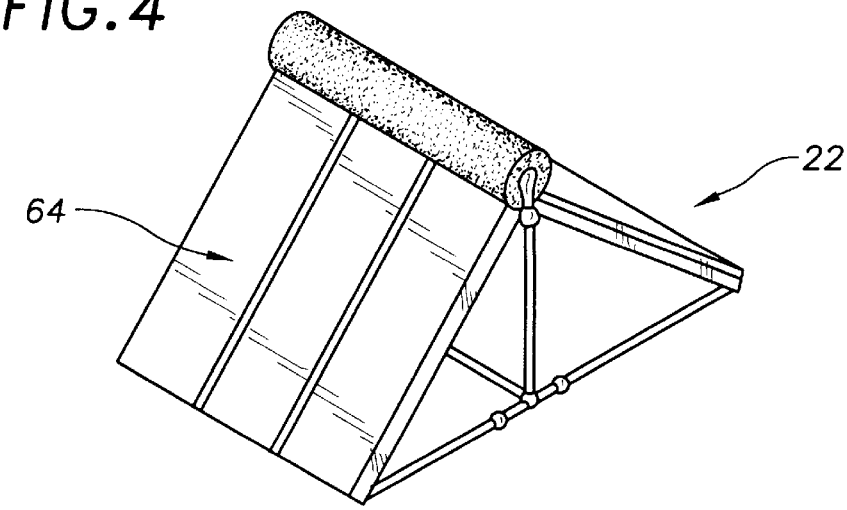
FIG. 4 is a second perspective view showing the planar padded scaling wall of the A-frame scaling structure.

Referring back to FIG. 1, A-frame scaling structure 22 includes a scaling structure support frame, generally designated 60; an angled mesh scaling wall, generally designated 62, supported by scaling structure support frame 60; a planar padded scaling wall, generally designated 64 (shown more clearly in FIG. 4), supported by scaling structure support frame 60; and a foam ridge structure, generally designated 66, positioned in connection with the top edges of angled mesh scaling wall 62 and planar padded scaling wall 64. A-frame scaling structure 22 is used as an obstacle element by requiring the children to scale either the mesh scaling wall 62 or the planar padded scaling wall 64, cross over foam ridge structure 66 and then descent the remaining scaling wall 62, 64.

It can be seen from the preceding description that a portable obstacle course system has been provided that is used as an entertainment activity for birthday parties and the like activities; that is easily transported to the activity site; that is rapidly set up in a variety of configurations and rapidly taken down; and that includes a number of boundary cones each having a number of boundary rod receiving fittings formed into the tip end thereof; a number of boundary rods each having rod ends sized to frictionally fit into the boundary rod receiving fittings of the boundary cones; two high stepper assemblies each including a framework defining a number of rectangular foot placement openings laid out in a grid pattern, the framework being covered with a resilient foam cushion; two tunnel assemblies each including a resilient mat assembly having three hingedly connected tunnel mat sections each having an upper surface provided with a number of tunnel support securing straps and a number of U-shaped tunnel supports that are provided with ground insertion ends adapted for insertion into the ground, the U-shaped tunnel supports and the three tunnel mat sections being sized such that the tunnel support securing straps are securable about sections of the U-shaped tunnel supports to hold the three tunnel mat sections in a tunnel configuration forming a tunnel passageway through which a child can crawl; and an A-frame scaling structure including a scaling structure support frame, an angled mesh scaling wall supported by the scaling structure support frame, a planar padded scaling wall supported by the scaling structure support frame, and a foam ridge structures positioned in connection with the top edges of the angled mesh scaling wall and the planar padded scaling wall.

It is noted that the embodiment of the portable obstacle course system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable obstacle course system comprising:

a number of boundary cones each having a number of boundary rod receiving fittings formed into the tip end thereof;

a number of boundary rods each having rod ends sized to frictionally fit into the boundary rod receiving fittings of the boundary cones;

two high stepper assemblies each including a framework defining a number of rectangular foot placement openings laid out in a grid pattern, the framework being covered with a resilient foam cushion;

two tunnel assemblies each including a resilient mat assembly having three hingedly connected tunnel mat sections each having an upper surface provided with a number of tunnel support securing straps and a number of U-shaped tunnel supports that are provided with ground insertion ends adapted for insertion into the ground, the U-shaped tunnel supports and the three tunnel mat sections being sized such that the tunnel support securing straps are securable about sections of the U-shaped tunnel supports to hold the three tunnel mat sections in a tunnel configuration forming a tunnel passageway through which a child can crawl; and an A-frame scaling structure including a scaling structure support frame, an angled mesh scaling wall supported by the scaling structure support frame, a planar padded scaling wall supported by the scaling structure support frame, and a foam ridge structures positioned in connection with the top edges of the angled mesh scaling wall and the planar padded scaling wall.

* * * * *